United States Patent [19]

Schütt et al.

[11] 4,419,913

[45] Dec. 13, 1983

[54] METHOD OF CUTTING PATTERNS IN WEB MATERIAL

[75] Inventors: Eduard Schütt, Hamburg; Günter Hell, Ellerau, both of Fed. Rep. of Germany

[73] Assignee: Aristo Graphic Systeme GmbH & Co., KG, Hamburg, Fed. Rep. of Germany

[21] Appl. No.: 294,686

[22] Filed: Aug. 20, 1981

[30] Foreign Application Priority Data

Sep. 13, 1980 [DE] Fed. Rep. of Germany ..... 3034621

[51] Int. Cl.[3] ..... B26D 7/20

[52] U.S. Cl. ..... 83/27; 83/29; 83/49; 83/422; 83/658; 83/925 CC

[58] Field of Search ..... 83/925 CC, 422, 56, 83/29, 266, 658, 659, 547, 31, 27, 49

[56] References Cited

U.S. PATENT DOCUMENTS

| | | | |
|---|---|---|---|
| Re. 17,085 | 9/1928 | Thomas | 83/547 X |
| 1,677,915 | 7/1928 | Crane | 83/658 X |
| 3,495,492 | 2/1970 | Gerber et al. | 83/925 CC |
| 3,566,726 | 3/1971 | Politis | 83/547 X |
| 3,585,888 | 6/1971 | Wiatt | 83/925 CC |
| 3,741,116 | 6/1973 | Green et al. | 101/287 |
| 3,765,289 | 10/1973 | Gerber et al. | 83/925 CC |
| 3,815,221 | 6/1974 | Pearl | 83/925 CC |
| 3,942,781 | 3/1976 | Gerber | 83/925 CC |
| 4,060,017 | 11/1977 | Backlund | 83/31 X |
| 4,176,566 | 12/1979 | Patterson | 83/925 CC |
| 4,201,101 | 5/1980 | Gerber | 83/925 CC |
| 4,205,835 | 6/1980 | Gerber | 83/925 CC |
| 4,322,993 | 4/1982 | Stumpf | 83/422 |

FOREIGN PATENT DOCUMENTS

| | | | |
|---|---|---|---|
| 2817382 | 10/1979 | Fed. Rep. of Germany | 83/925 CC |

*Primary Examiner*—James M. Meister

*Attorney, Agent, or Firm*—David H. Semmes; Warren E. Olsen

[57] ABSTRACT

Pattern making, particularly for the garment industry, including longitudinally advancing a web of pattern material onto a cutting table; simultaneously longitudinally advancing a web of fleece material in parallel contact with the pattern material, such that the web of fleece abuts the underside of the cardboard material; pulling a vacuum through said web of fleece, such that the pattern material is pulled towards the fleece; cutting patterns in the pattern material within the confines of the cutting table, such that a burr is formed on the underside of said pattern material and said burr engages said fleece material; simultaneously advancing the web of pattern material and the web of fleece away from the cutting area and separating the web of fleece from the pattern material, so that the cut patterns may be removed.

10 Claims, 1 Drawing Figure

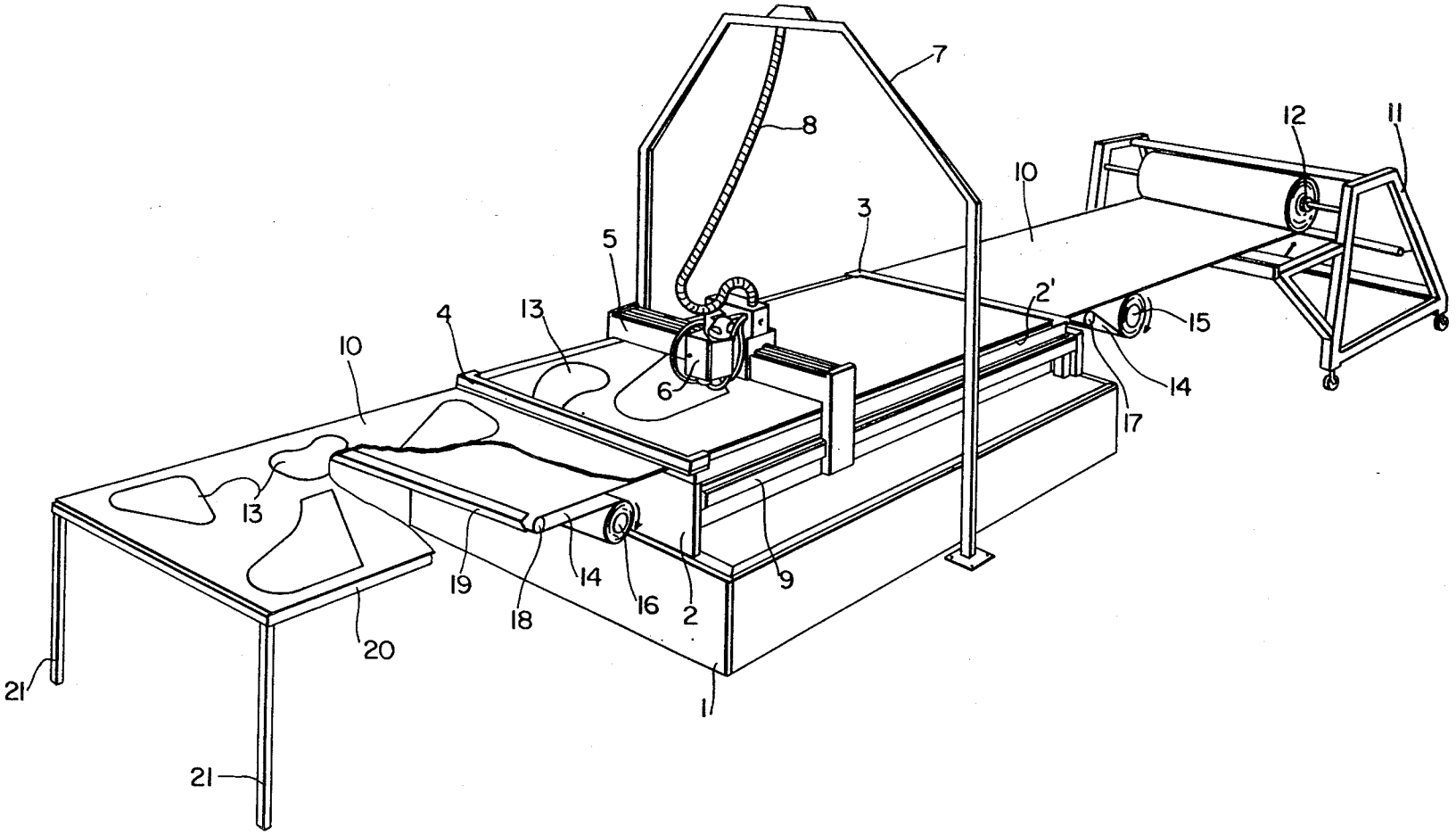
11
12
15
14
17
10
2'
7
3
8
9
11
2
16
6
5
14
13
18
4
19
10
20
13
21
21

METHOD OF CUTTING PATTERNS IN WEB MATERIAL

CROSS REFERENCES TO RELATED APPLICATIONS

Applicants claim priority of West German application Ser. No. P 30 34 621.5, filed Sept. 13, 1980.

BACKGROUND OF THE INVENTION (1) Field of the Invention

Pattern making, particularly the cutting of patterns from heavy paper or cardboard for use in the manufacture of garments.

(2) Description of the Prior Art

Being submitted separately.

SUMMARY OF THE INVENTION

The invention relates to a method for manufacture of patterns out of paper, plastic, cardboard or metal webs of pattern material by holding the same in place with a vacuum. A conventional cutting device is positioned transversely over the web of pattern material, which is advanced longitudinally onto a cutting table. The web of pattern material is advanced an additional segment after the patterns have been cut and the trailing segment is then processed with the cutting device. The basic characteristic of the invention is placing a segment of the web of pattern material into abutment with an underlying web of flexible material with a rough surface, such as fleece, that allows the passage of air. The width of web of fleece material corresponds to the width of the web of pattern material. After cutting of patterns, the web of material with the rough surface is advanced simultaneously with the segment of cut patterns lying on it, due to the engagement of the cut patterns with the underlying fleece.

Such cut patterns, for example, of paper or cardboard are required in great quantities for the production of cloth patterns for garments, if the garments are to be mass produced. In this case, the required corresponding cardboard patterns or the patterns of relatively heavy paper for garments are manufactured in several sizes, so that garments of the same shape, but of varying sizes can be manufactured.

To manufacture such patterns of cardboard or paper with the least time investment, cutting devices are used, which are essentially arranged in a similar way to the well known drafting equipment. In such "automatic" drafting equipment a drawing head is moved along rectangular coordinates, where generally one coordinate is supported in an axially movable mode along a transverse beam that holds the drawing head and another coordinate is arranged in the direction of movement of the transverse beam, vertical to its longitudinal axis. The control of these movements in such equipment is governed by computers, so that the desired course of lines can be drawn. If the drawing head of the well known drafting equipment is replaced by a cutting device, with a knife rotating at high speed, instead of the generation of lines from the "drawing source", patterns of corresponding shape can be cut out of a web of pattern material.

In order not to be limited either to the dimensions of the working table, or the working range of the cutting device, webs of heavy paper or cardboard are generally used. Patterns are cut out, in such a manner that after the processing of a segment of the web, the web may be re-advanced by the length of such segment, and the trailing segment may then be processed with the cutting device. In this way, it is possible to utilize the web material in a much more efficient way, since patterns can be cut in two adjoining segments, that is, a pattern is partially cut out from a first segment of the web. Then, the first segment is advanced, so that the cutting device completes cutting of the pattern in the trailing segment. In this way the deisred number of patterns can be manufactured quickly and economically.

There is a difficulty in this well known and conventional cutting process, in that when the web of pattern material is advanced to place the next segment to be processed within the cutting device, the previously cut out patterns detach themselves from the web of pattern material and end up underneath the web of advancing pattern material. It is then necessary to remove by hand the detached patterns from underneath the web of pattern material before a trailing segment of the web can be advanced into position for cutting. Such a removal process is not only time-consuming, but, also, is conducive to injury of the operating personnel, since the edges of the cut-out patterns are razor sharp and, therefore, can inflict cuts on the operator's hands.

It is, therefore, an object of the present invention to create a method in which the cut-out patterns are moved out of the working area of the cutting device, without ending up underneath the web of pattern material.

To solve this problem, a web of pattern material is advanced onto a cutting table within the range of movement of the cutting device. Within the cutting table area the pattern material rests upon a corresponding web of flexible material with a rough surface, for example, fleece, which will permit the passage of air and has a vertical resilience. The web of fleece should have a width corresponding to the width of the web of pattern material and is advanced longitudinally together with the web of pattern material, such that the web of fleece engages the underside of the pattern material.

In using the web with a rough surface, vacuum holding and positioning of the web of pattern material within the working area of the cutting device is possible, since the web with the rough surface permits the passage of air, so that the web of pattern material may be suctioned towards it. When the patterns are cut out with the aid of the cutting device, burred edges are produced at the lower edges of the patterns, as well as at the lower cut-out edges of the web. The burred edges then hook onto the web with the rough surface, so that the free moving web with rough surface is moved together with the web of pattern material when the latter is moved. On the other hand, the relative position of the web of pattern material cannot be changed by such movement, since both the web of pattern material and the cut patterns are hooked into the web with the rough surface.

In a preferential arrangement of the invention, the web of material with a rough surface is guided away and downwardly from the web of pattern material at the forward end of a table surface cutting area, while the web of pattern material is essentially moved parallel to the working surface. In this way a separation of the web with the rough surface and the web of pattern material is achieved and the patterns may then be separated easily from the web of pattern material.

The invention further concerns a cutting device for the production of patterns out of web of paper or cardboard pattern material and an underlying web of rough surface material in combination with a working table through the working surface of which a vacuum can be pulled to act on the web of pattern material. The invention, also, comprises a cutting device which is placed above a working table so that a freely movable web of flexible material with a rough surface that permits the passage of air, preferrably fleece is in an underlying abutment with a web of pattern on the surface of the working table.

The same advantages result from the use of such a cutting device, as described above in connection with the method which is the basis of the invention.

DESCRIPTION OF THE DRAWINGS

FIG. 1 is a partially fragmentary perspective of a pattern cutting table, arranged according to the present invention, wherein a longitudinally advancing web of pattern material is abutted with an underlying and longitudinally advancing web of fleece through a table cutting area.

DESCRIPTION OF PREFERRED EMBODIMENTS

In FIG. 1 the illustrated cutting device is illustrated as having a housing 1 in which both the control system (not illustrated) and a device to create a vacuum are housed and on which a working table 2 with a working surface 2' is placed. There are provided longitudinal guide rails 9 mounted on the working table, of which only one can be seen and which, as illustrated, is used to guide the transverse reciprocating rail 5 over the length of the working surface 2', and between wedge beams 3 and 4. A cutting head 6 with support housing is fastened reciprocably in a conventional manner to the transverse rail 5. The cutting knife is not shown. The housing with cutting head 6 is movable along the longitudinal axis of the transversal rail 5 over the surface 2' of the cutting table 2. A control cable 8 extends from the cutting head 6 to an arch 7 over the working table and 8 is fed into the arch in a way not illustrated for connecting to the control system within housing 1.

A feed roller 12 of thin cardboard pattern material 10 is placed upon a support frame 11. This web of cardboard material is guided, as illustrated, under the wedge clamping beams 3 and 4 and, therefore, spans the working surface 2'. Underneath the web of pattern material 10 a rotating feed roller 15 is mounted at one end of housing 11. A web 14 of relatively thin fleece is rolled up on roller 15. The width of the web of fleece 14 corresponds to the width of the web of cardboard pattern material 10. This web of fleece 14 is led over a first guide roller 17 and is led from guide roller 17 between working surface 2' and the web of cardboard pattern material 10. The fleece web 14 is guided over a second guide roller 18 at the opposed end of the working surface 2', so that web 14 is fed rearwardly and is parallel to its former course, prior to being rolled up on a freely rotating take-up roller 16. Immediately next to guide roller 18 a stripping rail 19 is placed horizontally under the moving cardboard web 10, so that fleece web 14 is guided downwardly between guide roller 18 and stripping rail 19. At the far end, away from stripping rail 19, a recovery table having a table surface 20 and legs 21 is provided. Those legs 21 which are connected to stripping rail 19 are not illustrated, having been removed for fragmentary illustration of web 10.

In the illustrated operating mode, cardboard web 10 is kept in position within the area of working surface 2' of table 2, by means of a vacuum which is pulled through fleece web 14, as well as by means of the application of wedge clamping beams 3 and 4, pivoted upon table 2. The desired patterns are then cut out of that segment of cardboard web 10, which is clamped between wedge beams 3 and 4. Cutting of the desired patterns is effected by movement of the computer controlled cutting head 6 and, also, the computered controlled transverse rail 5. During cutting, the cutting knife extends through cardboard web 10 slightly, so that fleece web 14 is slightly scratched, but the patterns are separated completely from the cardboard web 10. As a result, the cutting creates a burr on the underside of patterns 13 and on the corresponding cutout parts of cardboard web 10, which burrs into fleece web 14.

When all cuts to be made have been executed in the segment of cardboard web 10 which is clamped between wedges 3 and 4, the vacuum is turned off and air under light pressure is blown through the table working surface 2'. Furthermore, the wedge beams 3 and 4 are raised. The fleece web 14 is transported by a conventional motor driving of roller 16. Since both the freshly cut patterns 13 and the remaining web 10 are hooked to fleece web 14 by the created burrs, the web of cardboard pattern material 10 moves together with fleece web 14, as motor driven roller 16 is activated, and a displacement of the web of cardboard material 10 in relation to the cut patterns 13 is avoided.

In this method, the web of cardboard material 10 is unrolled from a feeding roller 12 and the freshly cut segment of cardboard material 10 is advanced beneath the raised wedge clamping beam 4. The web of cardboard material 10 advancing beneath wedge beam 4 and the cut patterns 13 are fed to the area of stripping rail 19, where fleece web 14 is separated from cut patterns 13. Separation is effected by stripping rail 19 interceding between the moving webs, 10 and 14, such that fleece web 14 is fed downwardly for take-up on roller 16. Cardboard web 10 and cut patterns 13 are transported, thusly, onto table surface 20, where cut patterns 13 and adjacent web 10 may be removed without difficulty. The trailing segment of cardboard web 10 that is advanced between wedge clamping beams 3 and 4 may then be processed similarly by means of the cutting tool mounted on cutting head 6, so that a created burr hooks into fleece web 14.

Those portions of cardboard web 10 remaining on table surface 20, after removal of the cutout patterns 13, can be cut off either by hand or may be deposited on the ground by continuing advance of cardboard web 10 over the edge of table 20.

As the entire fleece web 14 is unrolled from roller 15, then take-up roller 16, which is carrying the totality of fleece web 14, may be exchanged with the empty roller 15 so the fleece web 14 may be reused. Fleece web 14 may then be taken up on roller 15, as previously described.

We claim:

1. Method of cutting patterns in a web of pattern material comprising:

A. longitudinally advancing a web of pattern material onto a cutting surface;

B. simultaneously longitudinally advancing a web of rough surface material in parallel with the web of pattern material, such that the web of rough surface material abuts the underside of the pattern material while pulling a vacuum against the underside of the pattern material through the rough surface material, such that the pattern material adheres to the rough surface material during said cutting;

C. cutting a pattern in that portion of pattern material within the confines of said cutting surface, such that burrs are formed on the underside of the pattern material and the burrs act as hooks to engage the rough surface material;

D. releasing said vacuum and then simultaneously advancing the web of pattern material and the web of rough surface material away from the cutting surface as a consequence of said burr and rough surface engagement; and E. separating the web of rough surface material from the web of pattern material, such that the cut pattern may be removed.

2. Method of cutting patterns in a web of pattern material, as in claim 1 wherein the rough surface material is fleece.

3. Method of cutting patterns from a moving web of pattern material as in claim 2, wherein the pattern material is cardboard.

4. Method of cutting patterns from a moving web of pattern material as in claim 2, wherein the pattern material is heavy paper.

5. Method of cutting patterns from a moving web of pattern material as in claim 2, including:

G. clamping the web of pattern material and the abutting web of fleece onto said cutting surface during cutting.

6. Method of cutting patterns from a moving web of pattern material as in claim 5, wherein said separating of the web of fleece and the web of pattern material is by diverting said web of fleece into a plane out of contact with said pattern material.

7. Method of cutting patterns from a moving web of pattern material as in claim 6, wherein the web of pattern material and the web of fleece material are of equivalent lateral dimension.

8. Method of cutting patterns from a moving web of pattern material as in claim 7, wherein said separating includes rolling up said web of fleece upon a rotatable transverse axis positioned beneath said advancing web of pattern material.

9. Method of cutting patterns from a moving web of pattern material as in claim 5, including cutting a plurality of patterns during said clamping.

10. Method of cutting patterns from a moving web of pattern material as in claim 5, including forcing air through the web of fleece material, sequentially of said clamping and cutting.

* * * * *